US006435434B1

(12) United States Patent
Monyak

(10) Patent No.: US 6,435,434 B1
(45) Date of Patent: Aug. 20, 2002

(54) STRIKER BAR FOR DISINTEGRATING BREAKABLE MATERIALS

(75) Inventor: Kenneth Monyak, Abingdon, VA (US)

(73) Assignee: Sandvik Rock Tools, Inc., Bristol, VA (US)

( * ) Notice: Subject to any disclaimer, the term of this patent is extended or adjusted under 35 U.S.C. 154(b) by 0 days.

(21) Appl. No.: 09/676,954

(22) Filed: Oct. 2, 2000

(51) Int. Cl.[7] ..... B02C 13/28
(52) U.S. Cl. ..... 241/197; 241/294; 241/300
(58) Field of Search ..... 241/27, 294, 197, 241/242, 243, 73, 300

(56) References Cited

U.S. PATENT DOCUMENTS

| | | | | | |
|---|---|---|---|---|---|
| 4,066,216 | A | | 1/1978 | Waldrop et al. | |
| 4,546,929 | A | * | 10/1985 | Fritsch et al. | 241/294 |
| 4,586,663 | A | | 5/1986 | Bartley | |
| 5,096,129 | A | | 3/1992 | Gilbert et al. | |
| 5,100,070 | A | | 3/1992 | Montgomery, Sr. | |
| 5,165,611 | A | | 11/1992 | Ragnarsson | |
| 5,897,066 | A | * | 4/1999 | Bacon et al. | 241/160 |
| 5,941,469 | A | * | 8/1999 | Spiegemacher | 241/291 |
| 5,950,942 | A | | 9/1999 | Brand et al. | |
| 5,950,945 | A | * | 9/1999 | Schaller | 241/189.1 |
| 6,322,012 | B1 | * | 11/2001 | Paper | 241/243 |

* cited by examiner

*Primary Examiner*—Mark Rosenbaum
(74) *Attorney, Agent, or Firm*—Burns, Doane, Swecker & Mathis, L.L.P.

(57) ABSTRACT

A mechanism for disintegrating breakable materials, such as wood, pipes, bricks, etc. includes a rotary drum having striker bars mounted thereon which disintegrate the breakable materials. Each striker bar has a notched cutting edge formed by a row of carbide tips sintered to an edge of a steel body. The cutting edge can be of serrated shape and/or scallop-shape.

16 Claims, 4 Drawing Sheets

FIG. 1
(PRIOR ART)
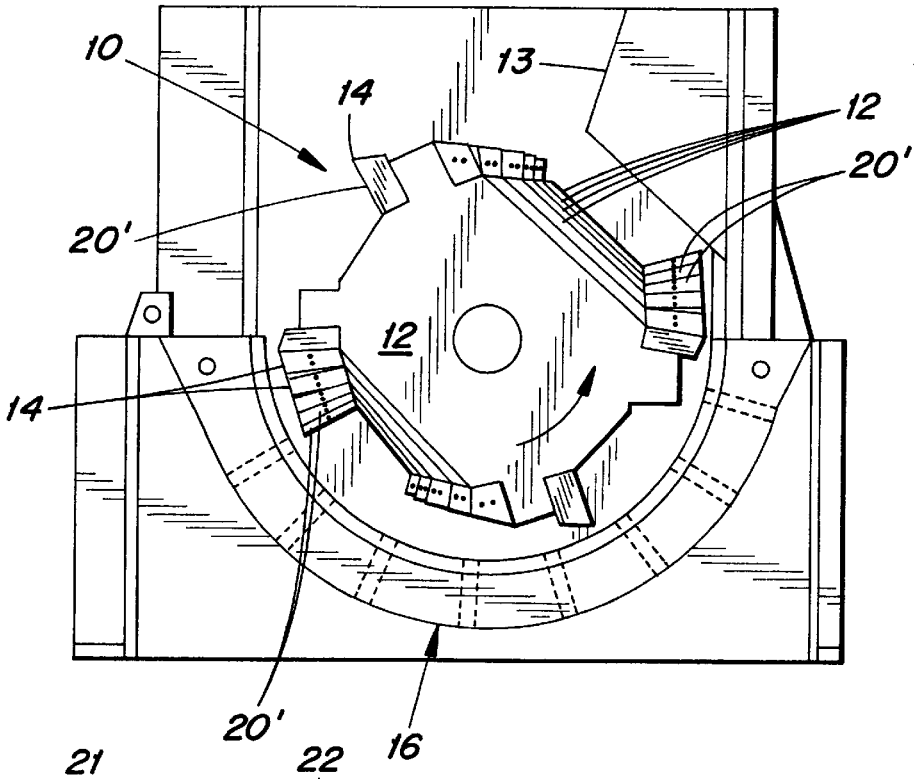
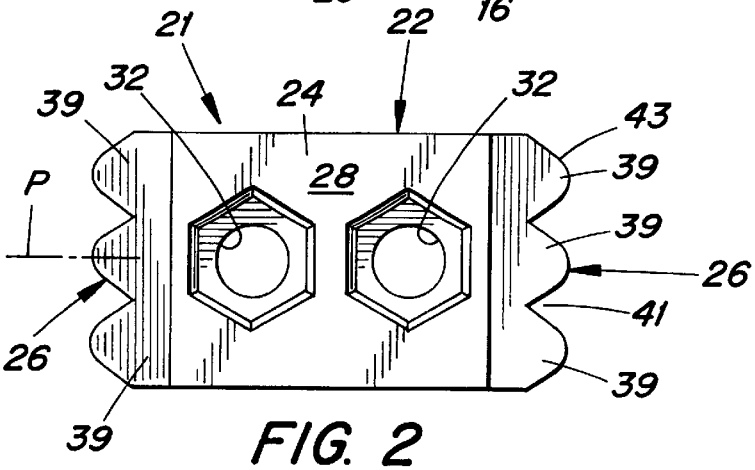
FIG. 2
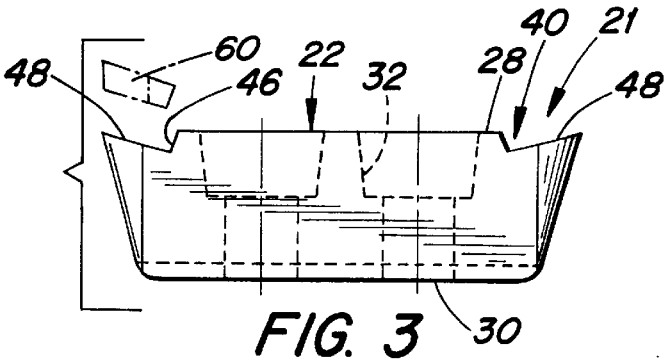
FIG. 3
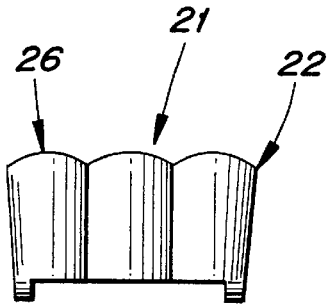
FIG. 4

FIG. 5
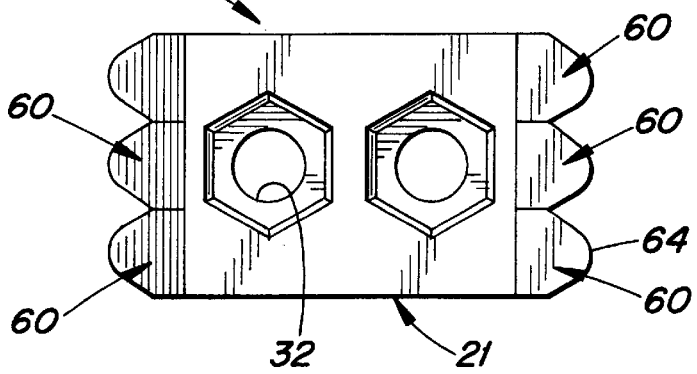
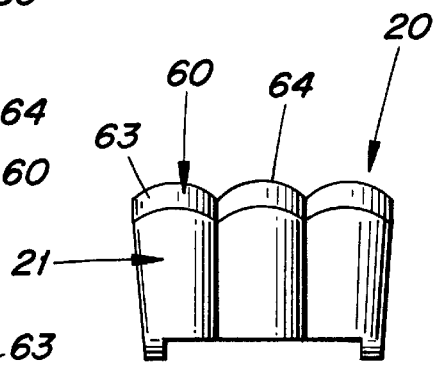
FIG. 7
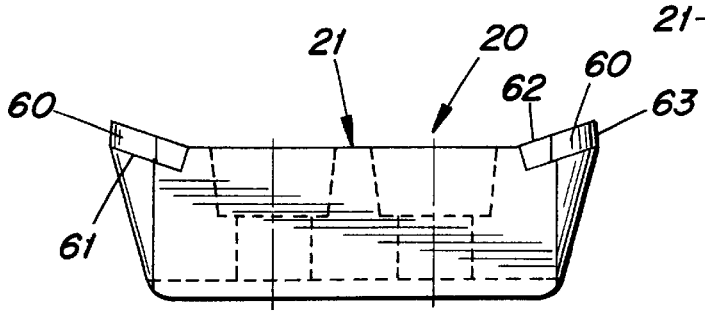
FIG. 6
FIG. 8
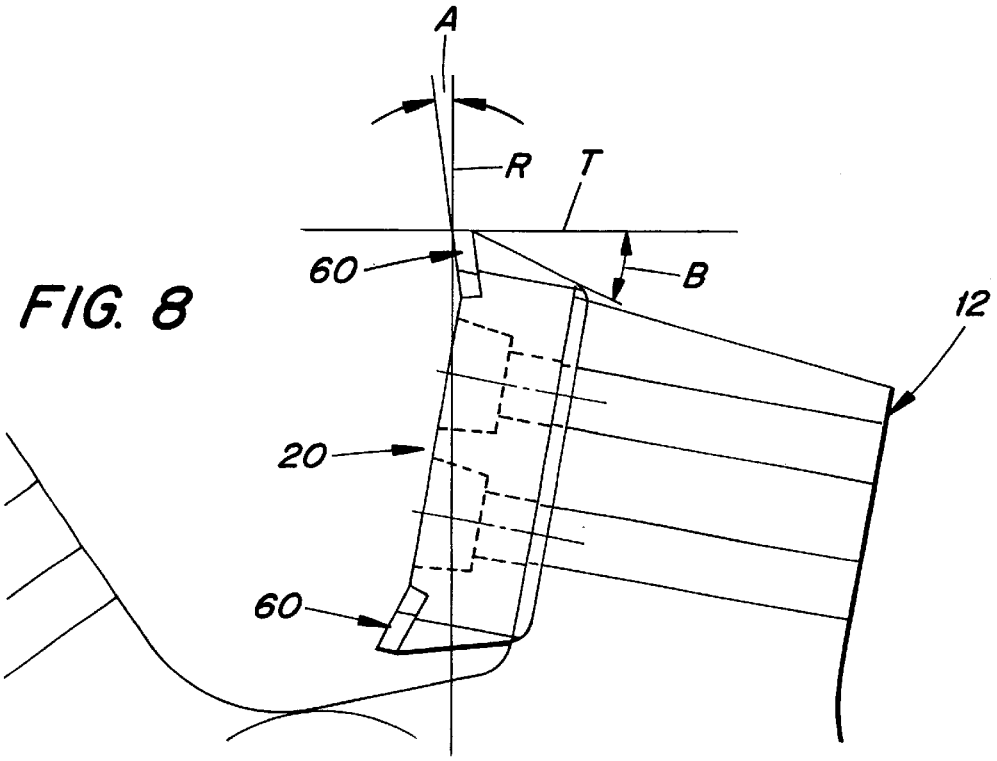

FIG. 9
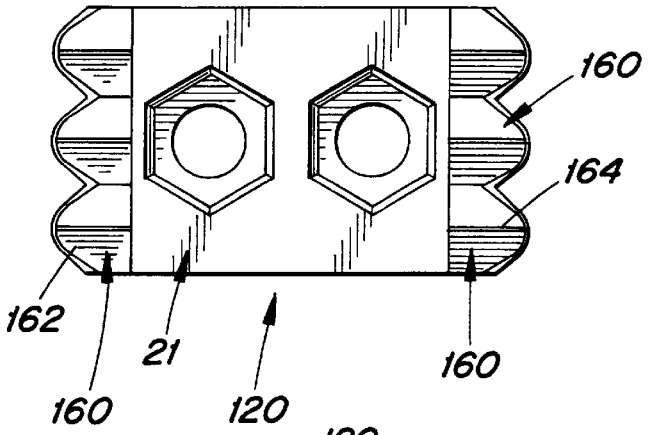
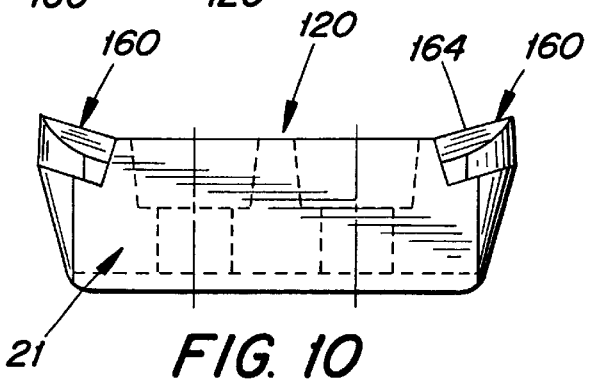
FIG. 10
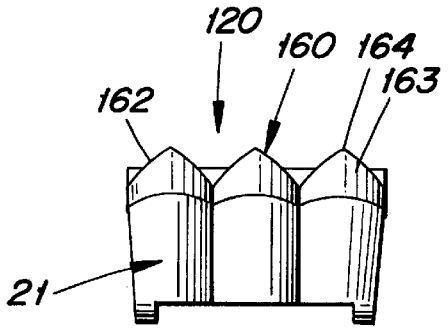
FIG. 11
FIG. 12
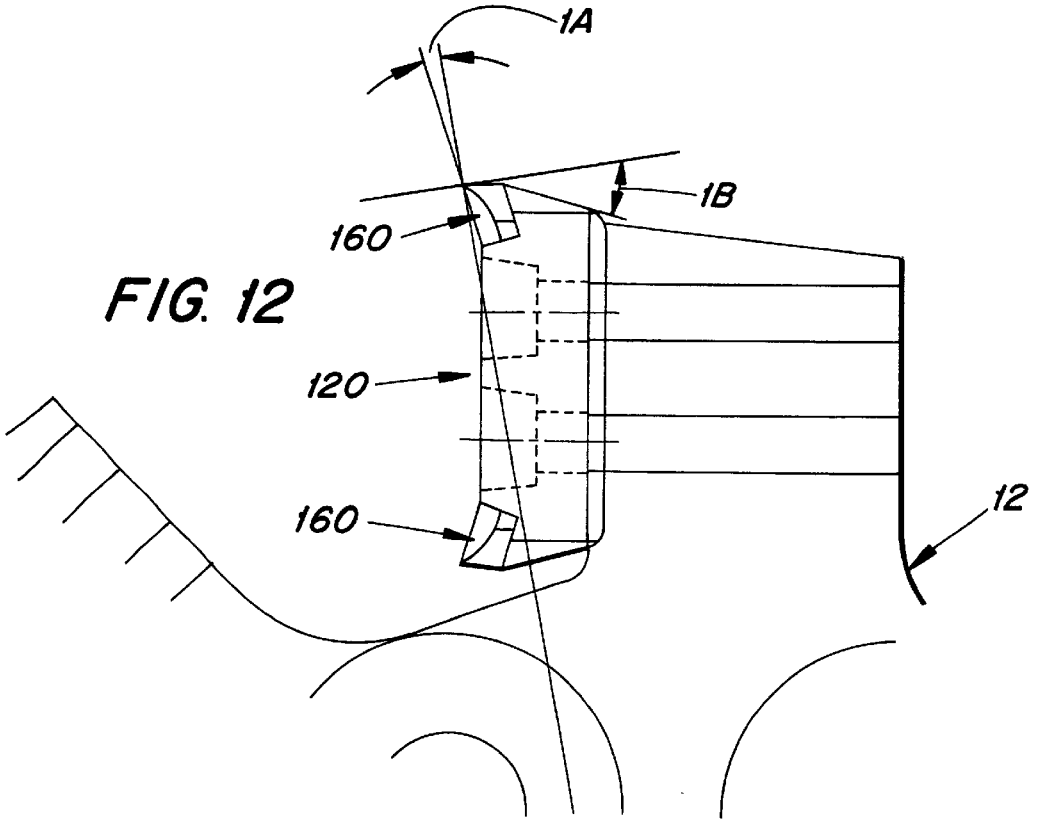

FIG. 13
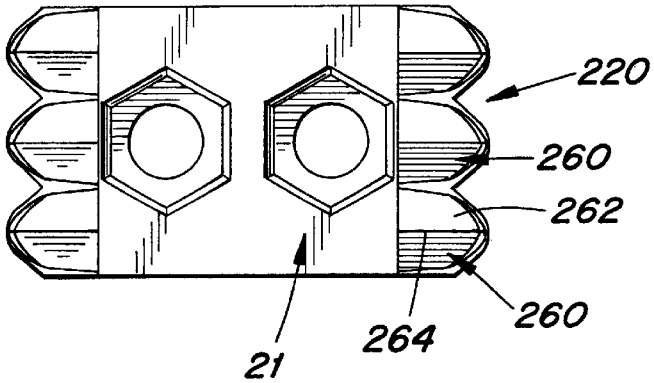
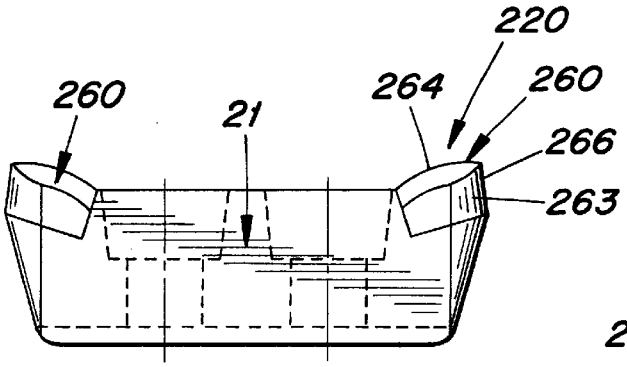
FIG. 14
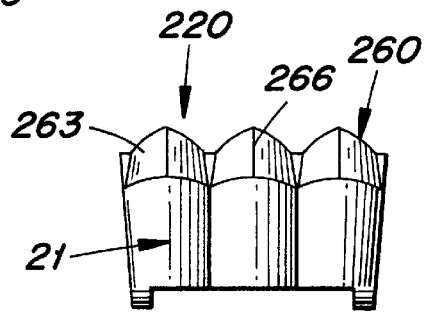
FIG. 15
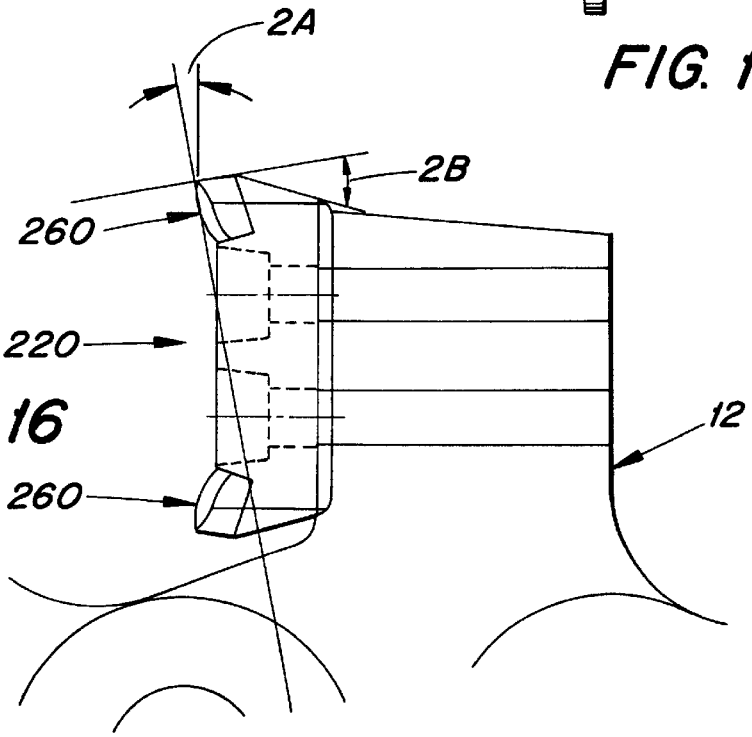
FIG. 16

STRIKER BAR FOR DISINTEGRATING BREAKABLE MATERIALS

BACKGROUND AND OBJECTS OF THE INVENTION

The invention pertains to an apparatus for disintegrating breakable materials, such as wood, cinder block, brick, pipes, etc., and especially relates to striker bars, which disintegrate breakable materials by being impacted thereagainst.

It is conventional to disintegrate or comminute breakable materials such as wood and residual building materials, e.g., bricks, concrete blocks, pipes, for example, by means of so-called hammer hogs, hammer mills, rotor hogs, tub grinders, etc. Those devices operate under the basic principle of rotating a drum to bring grinding elements, carried by the drum, into contact with the materials to be ground. The grinding elements have straight edges that can be hard-faced with carbide, which contact the materials and produce a grinding or crushing action which gradually wears away the materials. As pieces of the materials become ground small enough, they travel through a screen or grating which partially surrounds the drum at a slight distance. The screen can be disposed above or below the drum, and the materials can be introduced between the drum and screen in a radial or axial direction with reference to an axis of rotation of the drum. The grinding elements can be fixed to the drum so as to be immovable relative thereto, or swingable relative to the drum about respective hinge pins.

Material disintegrators of that general type are disclosed, for example, in U.S. Pat. Nos. 4,066,216; 5,165,611; 5,096,129; 5,950,942 and 4,586,663. Depicted in the accompanying FIG. 1 is a driven rotary drum 10 of the general type disclosed in U.S. Pat. No. 5,165,611. The drum includes a plurality of coaxial segments 12, each having circumferentially spaced seats for receiving respective striker plates or bars 20'. Each striker bar 20' is bolted to its respective seat and presents a straight edge 14 which engages and crushes the material introduced through an inlet 13. As the material becomes crushed into pieces of a small enough size, the pieces pass through a grate 16 disposed beneath the drum.

Since the striker bars 20' function primarily to crush and grind the materials, considerable energy is expended during operation. Also, much dust and small particles are produced. The cutting edges, even though having been hard-faced with carbide, tend to wear at a relatively rapid rate.

It would be desirable, therefore, to provide a striker bar which requires less energy while increasing the throughput rate of the materials. It would also be desirable to enable the amount of dust and small particles generated during operation to be reduced, as well as to increase the useful life of the striker bars.

SUMMARY OF THE INVENTION

The present invention relates to a striker bar adapted for use on a rotary holder for disintegrating materials. The striker bar comprises a support body having top and bottom surfaces. The top surface includes an edge portion. Cutting tips are fixed to the body and extend along the edge portion. The cutting tips are formed of a harder material than the body, and the cutting tips together form a notched cutting edge, such as a serrated or scallop shaped cutting edge.

The invention also pertains to an apparatus for disintegrating breakable materials, comprising a rotary drum and a plurality of the above-described striker bars mounted thereon.

The invention also pertains to a method of disintegrating material by rotating such a drum.

BRIEF DESCRIPTION OF THE DRAWINGS

The objects and advantages of the invention will become apparent from the following detailed description of preferred embodiments thereof in connection with the accompanying drawings in which like numerals designate like elements and in which:

FIG. 1 is a schematic side elevational view of a prior art material-disintegrating apparatus;

FIG. 2 is a top plan view of a blank portion of a striker bar according to the present invention;

FIG. 3 is a side elevational view of the blank depicted in FIG. 2;

FIG. 4 is an end elevational view of the blank depicted in FIG. 2;

FIG. 5 is a top plan view of a first embodiment of a striker bar according to the present invention;

FIG. 6 is a side elevational view of FIG. 5;

FIG. 7 is an end elevational view of FIG. 5;

FIG. 8 is a fragmentary side view showing the striker bar of FIGS. 5–7 mounted on a rotary drum;

FIG. 9 is a top plan view of a second embodiment of striker bar according to the present invention;

FIG. 10 is a side elevational view of FIG. 9;

FIG. 11 is an end elevational view of FIG. 9;

FIG. 12 is a fragmentary side view showing the striker bar of FIGS. 9–11 mounted on a rotary drum;

FIG. 13 is a top plan view of a third embodiment of a striker bar according to the present invention;

FIG. 14 is a side elevational view of FIG. 13;

FIG. 15 is an end elevational view of FIG. 13; and

FIG. 16 is a fragmentary side view showing the striker bar of FIGS. 13–15 mounted on a rotary drum.

DETAILED DESCRIPTION OF PREFERRED EMBODIMENTS OF THE INVENTION

A striker bar 20 (see FIGS. 2–4) according to the present invention comprises a blank or support body 21 and a plurality of cutting tips 60 mounted thereon. The blank is in the form of a generally rectangular steel body 22 having a center mounting portion 24 and first and second identical edge portions 26, 26 disposed at opposite ends of a top surface 28 of the body (see FIGS. 2–4). The body also includes a bottom surface 30. Through-holes 32 are formed through the mounting portion 24 for receiving fasteners to secure the striker bar to a drum or other rotary holder.

The top surface 28 has two grooves 40, each formed between the mounting portion 24 and a respective edge 26. Each groove 40 includes an inner surface 46 and an outer surface 48, the surfaces 46 and 48 oriented at a right angle with one another, whereby the groove is of generally V-shaped cross section as the blank is viewed from the side (see FIG. 3). The outer surface 48 is inclined upwardly and outwardly from a lower end of the inner surface 46.

Each edge includes spaced apart notches 41, and the tips 43 of the thus-notched edge 26 are curved, resulting in a scallop-like edge configuration (see FIG. 2). The regions of the surface 48 that are separated by the notches constitute laterally adjacent projections which define support surfaces 39. Sintered onto each of the support surfaces 39 is a preformed cutting tip formed of a harder material than the body 21. For example, the body 21 can be formed of steel, and the cutting tips could be formed of carbide. At each end of the body 21 there is thus provided a row of cutting tips which cooperate to form a generally scallop-shaped cutting edge.

Three preferred cutting tip configurations are disclosed herebelow. A first of those cutting tips 60 is depicted in FIGS. 5–8. That cutting tip 60 includes a flat bottom face 61 seated on the respective support surface 39, a flat top rake face 62, a clearance face 63, and a convexly curved cutting edge segment 64 which follows the contour of the outer edge 26 of the support surface 39. The cutting edge segment 64 is defined by a line of intersection between the rake face 62 and the clearance face 63. The cutting edge segments 64 at each end of the striker bar 20 together form a notched cutting edge, preferably of scallop-shape, whereby the striker bar 20 has two scallop-shaped cutting edges at respective ends of the striker bar that are usable alternatively, i.e., the striker bar can be reversed to present a new scalloped cutting edge. Adjacent ones of the cutting tips 60 are spaced apart by a notch arranged in overlying relationship to one of the notches 41, as is evident from FIG. 5. In lieu of a scallop shape, the tips could be pointed to form a serrated cutting edge. Eventually, the points would wear and the edges would assume a scallop shape.

In use, the striker bars 20 are mounted on the rotary drum of an apparatus such as that shown in FIG. 1 for example (i.e., in lieu of the striker bars 20' shown therein). As shown in FIG. 8, the orientation of each striker bar 20 is such that a rake angle A (defined as a positive rake herein) formed by a drum radius R and a plane of the rake face 62 of each active cutting tip 60 is in the range of about 6 to 9 degrees, preferably about 8 degrees. Also, a clearance angle B formed by a drum tangent T and a plane of the clearance face 63 is in the range of 23–27 degrees, preferably about 25 degrees.

Breakable materials, such as wood, pipe, concrete blocks, bricks, etc., would be introduced through the inlet 13 and acted upon by the cutting edges of the striker bars 20 as the striker bars pass across the grate 16. The cutting edges, due to their notched shape, form teeth that are able to effectively cut through the materials rather than merely crushing the materials as do conventional striker bars. This serves to lower the energy required to disintegrate the materials and reduce the amount of dust and small particles that is generated and entrained in the surrounding air. The disintegration is performed relatively quickly, enabling the production rate to be increased. Also, the cutting edges tend to be self sharpening and therefore last longer.

The inventive striker bars 20 can be mounted on any type of apparatus, including but not limited to the apparatus shown in FIG. 1.

A striker bar 120 having alternative cutting tips 160 is depicted in FIGS. 9–12. The striker bar includes a blank 21 preferably configured the same as in the embodiment disclosed in connection with FIGS. 5–8. The cutting tip 160, rather than having a flat top surface, has a top surface 162 comprised of portions that converge upwardly to form a somewhat sharp edge 164. The front surface 163 of each tip is of generally rounded convex shape. Thus, each notched cutting edge is of generally scallop shape when the striker bar is viewed in a first direction toward the top surface, (FIG. 9) and of generally serrated shape when the striker bar is viewed in a second direction perpendicular to the first direction (FIG. 11). When mounted on a drum 12 (FIG. 12), the rake angle 1 A is positive and in the range of about 6 to 9 degrees, preferably about 8 degrees. The clearance angle 1B is in the range of about 23–27 degrees, preferably about 26 degrees (see FIG. 12).

A third striker bar configuration 220 is depicted in FIGS. 13–16. In that embodiment, the cutting tip 260 has a top surface 262 which forms an edge 264, as well as a front surface 263 which also forms an edge 266 that is aligned with the edge 264 when the striker bar is viewed in plan (FIG. 13). Thus, each notched cutting edge is of generally serrated shape as viewed either in plan (FIG. 13) or from the end (FIG. 15). When mounted on a drum 12, each cutting tip forms a negative rake angle 2A in the range of −10 to −15 degrees, preferably about −12 degrees, and a clearance angle 2B in the range of 23–27 degrees, preferably about 26 degrees.

It will be appreciated that a striker bar 20, 120, 220 according to the present invention includes a notched cutting edge formed by hard cutting edges which are able to cut through a bulk inflow of breakable materials, rather than merely crushing them. That reduces energy expenditures and dust formation, as well as accelerating the disintegration rate of the materials.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A striker bar adapted for use on a rotary holder for disintegrating breakable materials, the striker bar comprising a support body having top and bottom surfaces, the top surface including an edge portion, the edge portion comprising a plurality of projections spaced apart by at least one first notch, a row of cutting tips fixed to the body and extending along the edge portion; the cutting tips mounted on respective ones of the projections and spaced apart by at least one second notch arranged in overlying relationship to the at least one first notch, the cutting tips formed of a harder material than the body; the row of cutting tips together forming a notched cutting edge, with each tip forming a segment of the notched cutting edge.

2. The striker bar according to claim 1 wherein the notched cutting edge is generally scallop-shaped.

3. The striker bar according to claim 1 wherein the notched cutting edge is generally serrated-shaped.

4. The striker bar according to claim 1 wherein the cutting edge is scallop-shaped when the insert is viewed in a first direction toward the top surface, and serrated-shaped when the insert is viewed in a direction perpendicular to the first direction.

5. The striker bar according to claim 1 wherein the body is of generally rectangular shape, there being two of the edge portions disposed at opposite ends of the body.

6. The striker bar according to claim 1 wherein the edge portion of the body includes a groove formed by an upwardly facing mounting surface and a generally upright side surface facing away from a center of the body; the mounting surface including a notched edge corresponding to the notched cutting edge.

7. The striker bar according to claim 6 wherein the supporting surface is inclined upwardly in a direction away from a center of the body.

8. The striker bar according to claim 1 wherein the edge portion comprises more than two projections, adjacent ones of the projections separated by a notch.

9. The striker bar according to claim 1 wherein the top surface is generally flat.

10. The striker bar according to claim 1 wherein the top surface includes two portions converging upwardly to form an edge.

11. The striker bar according to claim 10 wherein the top surface is generally arc-shaped as viewed in side elevation.

12. The striker bar according to claim 1 wherein the front surface includes two portions converging to form an edge.

13. The striker bar according to claim 1 wherein the body is formed of steel, and the cutting tips are formed of cemented carbide.

14. An apparatus for disintegrating breakable materials, comprising:

a rotary drum; and a plurality of striker bars mounted on the drum, each striker bar including: a body having top and bottom surfaces, the top surface including a plurality of edge portions, at least one of the edge portions comprising a plurality of projections spaced apart by at least one first notch, a row of cutting tips fixed to the body and extending along the at least one edge portion; the cutting tips mounted on respective ones of the projections and spaced apart by at least one second notch arranged in overlying relationship to the at least one first notch, the cutting tips formed of a harder material than the body; the row of cutting tips together forming a notched cutting edge, with each tip forming a section of the notched cutting edge.

15. The apparatus according to claim 14 wherein each striker bar is oriented on the drum to form a rake angle in the range of about 6 to 9 degrees, and a clearance angle in the range of about 23–27 degrees.

16. The apparatus according to claim 14 wherein each striker bar is oriented on the drum to form a rake angle in the range of about −10 to −15 degrees, and a clearance angle in the range of 23 to 27 degrees.

* * * * *